US005941175A

United States Patent [19]

Bannister

[11] Patent Number: 5,941,175

[45] Date of Patent: Aug. 24, 1999

[54] PATIENT SUPPORT TABLE

[75] Inventor: Graham David Bannister, Lindfield, United Kingdom

[73] Assignee: Smiths Industries Public Limited Company, London, United Kingdom

[21] Appl. No.: 08/956,373

[22] Filed: Oct. 23, 1997

[30] Foreign Application Priority Data

Nov. 30, 1996 [GB] United Kingdom ..... 9624990

[51] Int. Cl.[6] ..... A47B 85/00

[52] U.S. Cl. ..... 108/20; 5/624; 5/648

[58] Field of Search ..... 108/20; 5/602, 5/624, 648, 650, 651, 618; 297/344.16, 344.19

[56] References Cited

U.S. PATENT DOCUMENTS

| | | | |
|---|---|---|---|
| 3,226,105 | 12/1965 | Weickgenannt et al. | 5/624 |
| 3,318,596 | 5/1967 | Herzog | 5/602 X |
| 3,817,512 | 6/1974 | Torrey . | |
| 3,868,103 | 2/1975 | Pageot et al. . | |
| 4,426,071 | 1/1984 | Klevstad . | |
| 4,886,258 | 12/1989 | Scott . | |
| 5,148,562 | 9/1992 | Borders et al. | 5/602 X |
| 5,645,079 | 7/1997 | Zahiri et al. . | |
| 5,740,572 | 4/1998 | Hannant | 5/624 |

FOREIGN PATENT DOCUMENTS

| | | | |
|---|---|---|---|
| 1518724 | 2/1968 | France . | |
| 2666013 | 2/1992 | France . | |
| 2324486 | 12/1973 | Germany | 5/602 |

*Primary Examiner*—Jose V. Chen
*Attorney, Agent, or Firm*—Pollock, Vande Sande & Amernick

[57] ABSTRACT

A surgical operating table has leg sections, which are displaceable about a vertical axis and a horizontal axis. Each leg section is locked in position by two gas struts, which lock respectively about the vertical and horizontal axes. Vent buttons on the gas struts are connected via push rods to opposite ends of a lateral beam. The lateral beam is engaged, close to the end coupled to the strut locking about the vertical axis, by a manual release handle beneath the foot end of the leg section. Lifting the handle displaces the one end of the beam initially and then the other end, so that the leg section is released for movement about the vertical axis before it is released for movement about the horizontal axis.

10 Claims, 2 Drawing Sheets

PATIENT SUPPORT TABLE

BACKGROUND OF THE INVENTION

This invention relates to patient support tables, such as surgical operating tables.

Where surgery is performed on a patient's leg, it is often necessary to be able to support the leg at various different angles, both about a horizontal and vertical axis. To achieve this, the operating table has leg supports, which can be raised or lowered, or moved in or out, and locked in the desired position. The leg support may comprise a single plate extending along the length of the leg or it may be articulated in the region of the patient's knee, in the manner described in GB2297686. In conventional tables, separate locks are used to lock against movement about the vertical and horizontal axes. This complicates positioning of the leg supports because the separate locks make it more difficult to move the supports about both axes simultaneously.

BRIEF SUMMARY OF THE INVENTION

It is an object of the present invention to provide an improved patient support table.

According to the present invention there is provided a patient support table having a leg support movable about a first axis and about a second axis orthogonal to the first axis, first means for locking the leg support against movement about the first axis, second means for locking the leg support against movement about the second axis, and manual release means coupled with both the first and second locking means so that both the locking means can be released by operation of said manual release means.

The manual release means is preferably movable through a first position at which the first locking means is released to a second position at which the second locking means is released. The first axis is preferably a vertical axis and the second axis a horizontal axis. The first and second locking means may each include a fluid cylinder and a piston in the cylinder, the manual release means being operable to allow the piston to move along the cylinder. The first and second locking means may be coupled with the manual release means by respective elongate members extending longitudinally along the leg support, the elongate members being connected with the manual release means at an end remote from the locking means by a lateral member. The lateral member may be displaceable at right angles to its length, the lateral member being engaged by the manual release means towards one end of the lateral member such that displacement of the manual release means initially causes a greater force to be applied to the one end of the lateral member than to its opposite end. The manual release means is preferably a handle located beneath the leg support, such as at its foot end, and may be displaceable upwardly to release the first and second locking means.

A surgical operating table, in accordance with the present invention, will now be described, by way of example, with reference to the accompanying drawings.

DETAILED DESCRIPTION OF THE PREFERRED EMBODIMENT

Figure 1:
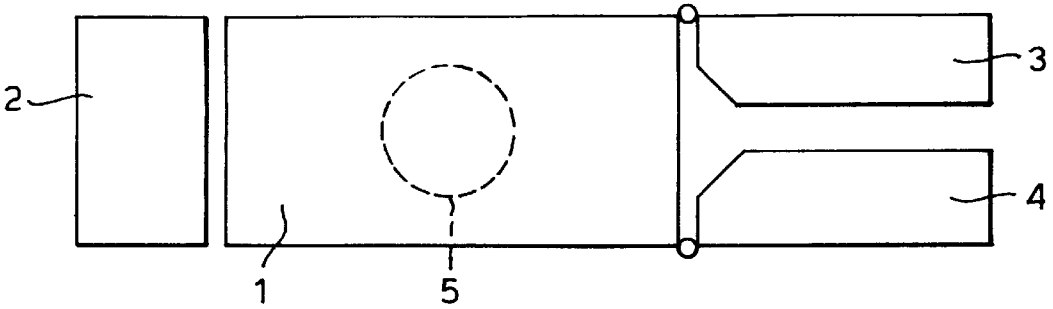
FIG. 1 is a plan view of the table.

The table has a main body support section 1, a head section 2 and two leg support sections 3 and 4. The main body support section 1 is mounted at the upper end of a pillar 5 and can be tilted about its longitudinal and lateral axes in the usual way. The two leg supports 3 and 4 are pivoted at one end with the main section 1 in a way that enables the foot end of each support to be independently moved up or down and swung out (abducted) or swung in.

Figure 2:
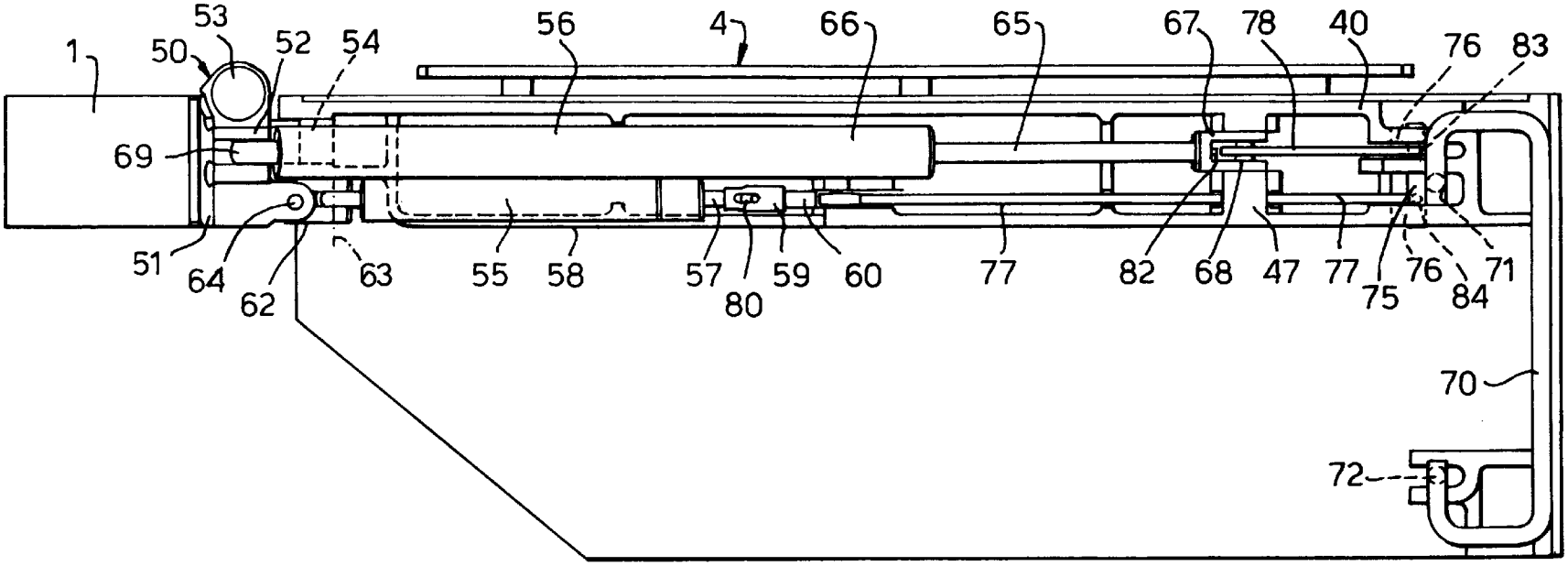
FIG. 2 is a view from below of one of the leg supports of the table, to an enlarged scale.
Figure 3:
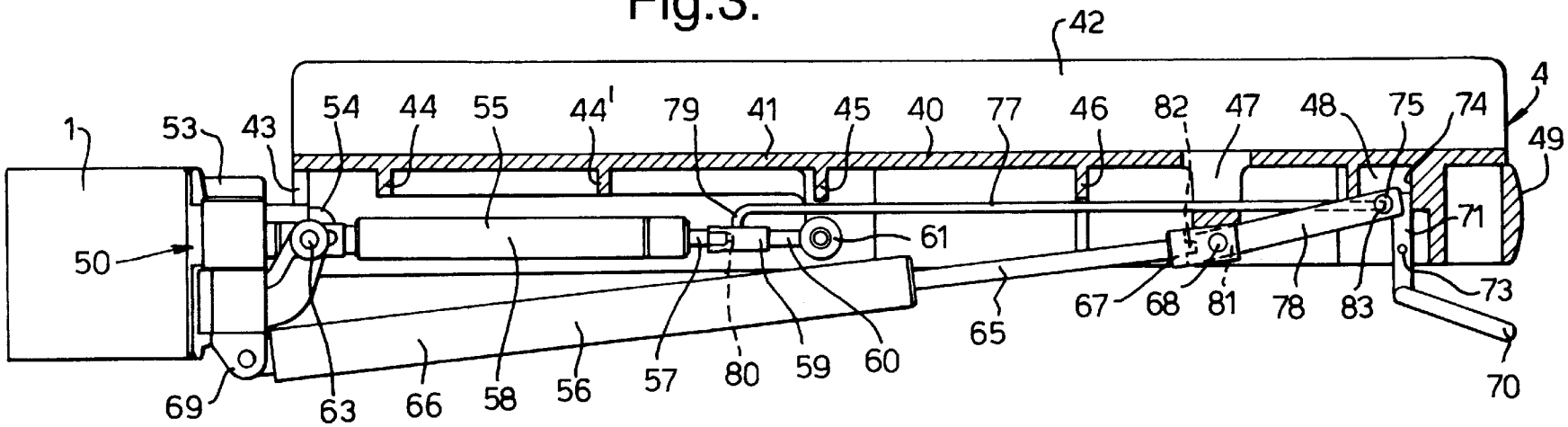
FIG. 3 is a partly sectional side elevation view of the leg support of FIG. 2.
Figure 4:
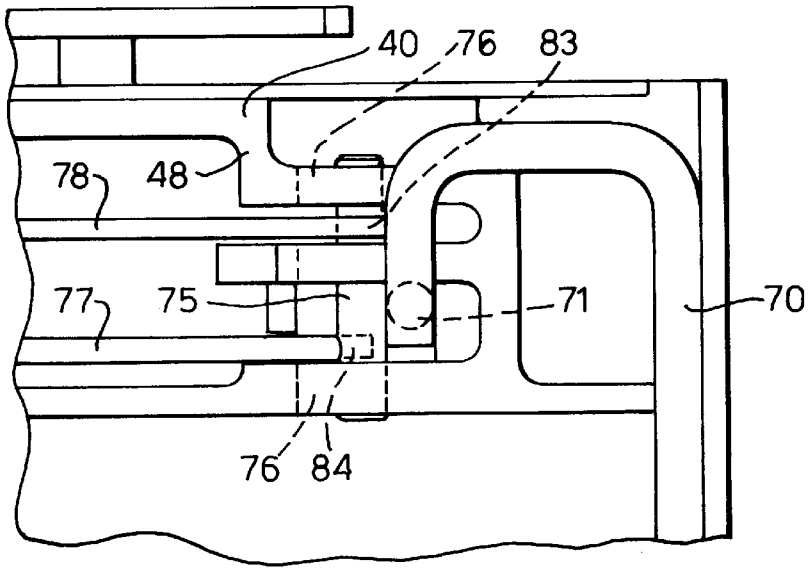
FIG. 4 shows a part of the view of FIG. 2 to a greater scale.

The construction of the one of the leg supports 4 will now be described in greater detail with reference to FIGS. 2 and 3. The other leg support 3 is constructed in the same way and is a mirror image of the first leg support 4.

The leg support 4 has a casting 40 of a rigid plastics or aluminum, with a flat upper plate 41 to which is secured a mattress 42, the upper surface of which supports the patient's leg. The casting 40 also has various struts 43 to 49 on the lower surface of the plate 41, to give the casting rigidity. The leg support 4 is mounted at its left-hand end to the right-hand end of the main section 1 by means of a universal hinge assembly 50. One half 51 of the hinge assembly 50 is fixed with the main section 1, the second half 52 of the assembly being connected with the first half by means of a joint 53 rotatable about a vertical axis. The second half 52 of the hinge assembly 50 is connected with the casting 40 of the leg support 4 by means of a joint 54 rotatable about a horizontal axis.

The leg support 4 is also supported relative to the main section 1 by two gas struts or cylinder assemblies 55 and 56. The first, abduction cylinder assembly 55 extends horizontally and is aligned longitudinally when the leg support 4 is horizontal and aligned longitudinally of the table. The first cylinder assembly 55 has a piston 57 movable along its length in a cylinder 58, the free, external end of the piston being connected via a coupling piece 59 to one end of a short rod 60. The other end of the rod 60 forms a rotatable connection with a spigot 61 projecting horizontally from the strut 45, about half way along the length of the support 4. The other end of the first cylinder assembly 55, provided by the closed end of the cylinder 58, is connected via a universal joint 62 to the half 51 of the hinge 50 fixed with the main section 1. The universal joint 62 enables the cylinder assembly 55 to be angularly displaced about a horizontal axis 63 and a vertical axis 64 about its closed end.

The second, elevation cylinder assembly 56 is located below and to one side of the first cylinder assembly 55. When the leg support 4 is flat and aligned longitudinally, as shown, the second cylinder assembly 56 is aligned longitudinally with the cylinder assembly 55, and is inclined upwardly, with the end closer to the foot of the table being higher than its other end. The second cylinder assembly 56 has a piston 65 slidable along a cylinder 66, the free end of the piston having a coupling 67. The coupling 67 is rotatably connected to a horizontal spindle 68, which is supported by the strut 47 located about midway between the strut 45 and the foot end of the leg support 4. The closed end of the cylinder 66 is connected by a horizontally-rotatable joint 69 to the second half 52 of the hinge 50.

Both the cylinder assemblies 55 and 56 are connected to a manual release handle 70 extending horizontally across the underside of the support 4 at its foot end. The handle 70 is bent to form two vertically extending arms 71 and 72, one at each end. The arms 71 and 72 are pivoted on horizontal arbors 73 (only one of which is shown) supported on the strut 48, about midway along their length. This arrangement is such that, when the handle 70 is lifted, the upper end of the arms 71 and 72 are displaced to the left. Downward displacement of the handle 70 from the position illustrated is prevented by engagement of the right-hand surface of the arms 71 and 72 with a left-facing surface 74 of the strut 48. The left side of one arm 71 bears against the right-hand side of a horizontal, lateral beam 75, which is supported at opposite ends in horizontal slots 76 in the strut 48. The beam 75 is connected to two push rods 77 and 78, which extend to respective ones of the couplings 59 and 67 connected at the end of the pistons 57 and 65.

The push rod 77 extends horizontally and is bent down at its left-hand end to form an actuating finger 79, which extends within the coupling 59. The piston 57 has a vent button 80 at its end, within the coupling 59. The vent button 80 is normally urged outwardly and prevents any flow of air between those parts of the cylinder 58 on opposite sides of the plunger of the piston 57. In this way, movement of the piston 57 relative to the cylinder 58 is prevented and the length of the cylinder assembly 55 is locked. Because the cylinder assembly 55 is attached to the main section 1 at a location away from the vertical joint 53, when the cylinder assembly is locked, it is not possible to move the leg support 4 about the axis of this joint. The cylinder assembly 55 thereby acts as a vertical axis lock. When, however, the push rod 77 is moved to the left, its actuating finger 79 depresses the button 80 and allows gas to flow between opposite ends of the cylinder 58, so that the piston 57 can move freely within the cylinder, thereby allowing the leg support 4 to be abducted freely about the vertical joint 53.

The other push rod 78 is in the form of a flat plate having its wider lateral dimension oriented vertically. At its left hand end, the rod 78 has a slot 81 aligned along the length of the rod, through which the spindle 68 extends, the length of the slot being about twice the diameter of the spindle. In its rest position, the push rod 78 is located with the spindle 68 at the left end of the slot 81 and with the left-hand end of the push rod just clear of a vent button 82 at the free end of the piston 65. The vent button 82 prevents gas flow between those parts of the cylinder 66 on opposite sides of the plunger of the piston 65 so that the cylinder assembly 56 is locked in length. Because the left-hand end of the elevation cylinder assembly 56 is connected with the second half 52 of the hinge assembly 50 below the axis of the joint 54, when the cylinder assembly is locked in length, it prevents displacement of the leg support 4 about the horizontal axis. The cylinder assembly 56 thereby acts as a horizontal axis lock. When the push rod 78 is displaced to the left, the slot 81 slides along the spindle 68 and the left-hand end of the push rod actuates the vent button 82 so that gas can flow between opposite ends of the cylinder 66, thereby allowing the piston 65 to move freely along the cylinder. This allows the leg support 4 to be displaced about the horizontal axis of the joint 54, so that the foot end of the support can be raised or lowered.

The right-hand end of the push rod 78 has a hole 83 through which the beam 75 extends. A blind hole 84 in the beam 75 loosely retains the right-hand end of the push rod 77. The vertical arm 71 of the manual release lever 70 engages the right-hand side of the beam 75 at a location closer to the push rod 77 than the push rod 78. When the manual release lever 70 is lifted up to a first position, the arm 71 is moved to the left, exerting a lateral force on the right-hand side of the beam 75. Movement of the beam 75 is constrained to a horizontal plane by the slots 76 in which the ends of the beam are located. Because lateral force exerted by the arm 71 is applied closer to the push rod 77, the major part of the force is applied to this push rod rather than the other push rod 78. Accordingly, the beam 75 rotates clockwise, when viewed from below (as in FIG. 2), about the hole 83 in the push rod 78, and the push rod 77 is displaced along its length, to the left, causing the vent button 80 to be actuated. When the vent button 80 has been fully depressed, further movement of the push rod 77 is prevented. Further movement of the manual release lever 70 to a second position now causes the beam 75 to rotate in the opposite sense, anticlockwise, about the blind hole 84 in which the push rod 77 is coupled. This movement of the beam 75 now causes the push rod 78 to be displaced forwardly along its length, to the left until the vent button 82 of the cylinder 66 is actuated. In this way, by lifting the handle 70 a small distance, the user can release the abduction cylinder assembly 55 to displace the leg support 4 out or in without altering its vertical position. When it is necessary to raise or lower the leg support 4, the user simply lifts the release handle 70 further. When both cylinder assemblies 55 and 56 are unlocked, the user can freely position the leg support 4 about both the horizontal and vertical axes.

It will be appreciated that various other forms of locks, other than the cylinder assemblies described, could be used to lock the leg supports against movement about the two axes. Other kinds of manual release means could be connected to the locks so that both locks can be operated by the manual release means.

What I claim is:

1. A patient support table comprising: a leg support movable about a first axis and about a second axis orthogonal to the first axis; a first lock for locking said leg support against movement about said first axis; a second lock for locking said leg support against movement about said second axis; a manual release located on said leg support, said manual release being movable from a locked position to an unlocked position; and a coupling between said manual release and both said first and second locks so arranged that both said locks are locked when said manual release is in its said locked position and both said locks can be released by moving said manual release to its said unlocked position to permit said leg support to be displaced relative to both said first and second axes by manual manipulation directly on said leg support.

2. A patient support table according to claim 1, wherein said manual release is movable through a first position at which said first lock is released to a second position at which said second lock is released.

3. A patient support table according to claim 1, wherein said first axis is a vertical axis and said second axis is a horizontal axis.

4. A patient support table according to claim 1, wherein each of said first and second locks includes a respective fluid cylinder and a piston in said cylinder, and wherein said manual release is operable to allow the piston in a respective one of said locks to move along the cylinder in said lock.

5. A patient support table according to claim 1, including first and second elongate members extending longitudinally along said leg support, a coupling between one end of said first and second elongate members and respective ones of said locks, and a lateral member, said lateral member interconnecting said elongate members with said manual release at an end remote from said locks.

6. A patient support table according to claim 5, wherein said lateral member is elongated and angularly displaceable relative to its length, and wherein said lateral member is engaged by said manual release towards one end of said lateral member such that displacement of said manual release initially causes a greater force to be applied to said one end of the lateral member than to an opposite end of said lateral member.

7. A patient support table according to claim 1, wherein said manual release includes a manually operable handle located beneath said leg support, and wherein said handle is displaceable upwardly to release said first and second locks.

8. A patient support table according to claim 1, wherein said manual release include a manually operable handle located beneath said leg support at a foot end of said leg support.

9. A patient support table comprising: a leg support movable about a first axis and about a second axis orthogonal to the first axis; a first gas strut for locking said leg support against movement about said first axis; a second gas strut for locking said leg support against movement about said second axis; and a manually operable release handle located on said leg support, said handle being movable from a locked position to an unlocked position, said handle being interconnected with both said gas struts so that both said gas struts are locked when said release handle is in said locked position, and both said struts can be released by manual operation of said release handle to said unlocked position so as to permit said leg support to be displaced relative to both said first axis and said second axis by manual manipulation directly on the leg support.

10. A patient support table according to claim 9, wherein said release handle is movable through a first unlocked position at which the locking action of said first gas strut is released to a second unlocked position at which the locking action of said second gas strut is released.

* * * * *